United States Patent [19]

Lauchenauer

[11] Patent Number: 4,588,614

[45] Date of Patent: May 13, 1986

[54] PSEUDOPLASTIC GEL TRANSFER

[75] Inventor: Alfred E. Lauchenauer, Horn, Switzerland

[73] Assignee: Adnovum AG, Horn, Switzerland

[21] Appl. No.: 627,482

[22] Filed: Jul. 2, 1984

Related U.S. Application Data

[63] Continuation of Ser. No. 435,530, Oct. 20, 1982, abandoned.

[30] Foreign Application Priority Data

Oct. 20, 1981 [GB] United Kingdom ..... 8131594
Feb. 19, 1982 [GB] United Kingdom ..... 8204990

[51] Int. Cl.[4] ..... B05D 3/02; B05D 3/12; B05D 5/00; B05D 7/24

[52] U.S. Cl. ..... 427/243; 427/278; 427/280; 427/288; 427/358; 427/365; 427/389.9; 427/392

[58] Field of Search ..... 427/243, 278, 288, 280, 427/281, 358, 365, 389.9, 392; 252/315.3

[56] References Cited

U.S. PATENT DOCUMENTS 2,278,056 3/1942 Boice ..... 427/278 X
2,673,819 3/1954 Wendell ..... 427/243 X
3,562,176 2/1971 Stancioff et al. ..... 252/315.3

FOREIGN PATENT DOCUMENTS 2811828 9/1978 Fed. Rep. of Germany ... 252/315.3

*Primary Examiner*—Evan K. Lawrence
*Attorney, Agent, or Firm*—Edwin E. Greigg

[57] ABSTRACT

A method for the incorporation of an active agent into a porous structural substrate which comprises forming a pseudoplastic gel comprising:
an active agent
at least one solvent therefor
and at least one gel forming agent and thereafter applying the gel to the structure to be treated. The penetration of the gel into the porous structure may be regulated by decreasing the viscosity of the gel by increasing the shear on the gel during its application to the porous structure. A predetermined gel penetration of the structure is achieved before 75% of the solvent has evaporated.

9 Claims, 2 Drawing Figures

PSEUDOPLASTIC GEL TRANSFER

Figure 1:
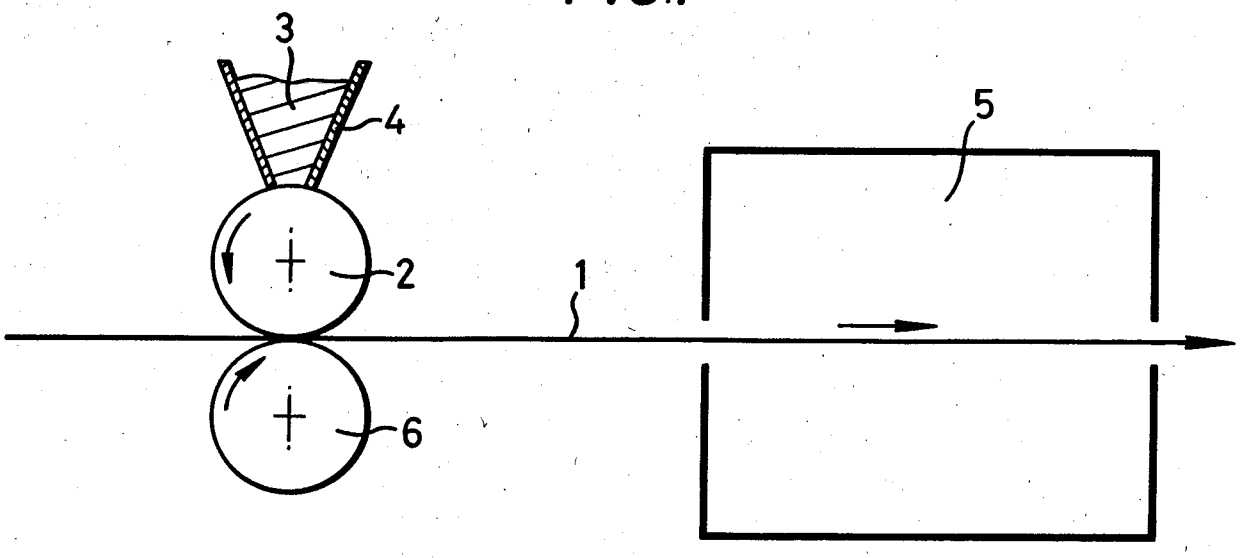

This is a continuation of copending application Ser. No. 435,530, filed Oct. 20, 1982, now abandoned.

The present invention relates to a method of forming a pseudoplastic gel containing an active agent and causing the penetration of the gel into a porous structure.

A variety of application systems for active agents to be applied to, and incorporated into, porous structures such as textile sheet material have been proposed and have been actually used commercially. The most widely used system is the padding of such porous structures in a solution of the agent, followed by squeezing or mangling in order to remove any excess solution.

In recent years methods have been developed which enable the application of much higher concentrations of the agents, e.g. the same amount of agent in much less water, thus saving drying energy and obtaining, in many cases, better effects since the low water add-on effectively prevents migration of the agents to fibre and yarn surfaces.

A number of drawbacks are inherent in these new, as well as in conventional, application methods. One disadvantage common to all these systems is the need to use relatively expensive equipment, e.g. padding mangles for padding systems, foaming devices and foam applicators for foam application systems, and roller or other applicators for kiss-coating or printing systems. Control of the process is a problem inherent to some procedures, whereas there are limitations as regards the agents which may be applied in respect of other systems.

According, therefore, to the present invention there is provided a method for the incorporation of an active agent to a structure which method comprises forming a pseudoplastic gel as hereinbefore defined comprising:

an active agent at least one solvent therefor, and at least one gel forming agent and thereafter applying said gel to the structure to be treated.

The term "pseudoplastic gel" as used throughout the specification is defined as a gel which due to the behaviour and configuration of the macro-molecules of the gel forming agent shows a non-Newtonian behaviour as regards the influence of mechanical action, in particular through shearing forces on the viscosity of the gel.

Among gels showing Newtonian behaviour the viscosity essentially depends, for a given concentration of the gel forming agent, only on the temperature. A pseudoplastic gel is, however, strongly influenced by mechanical movement in the gel, the viscosity decreasing with the strength of forces causing a shearing action which aligns the macromolecules forming the gel. (Encyclopaedia of Chemical Technology, Volume 11, pages 739–741).

Suitable gel-forming agents not only form pseudoplastic gels, but they are not influenced by the presence of ions; they preferably produce per se as little stiffening as possible, they are colourless, do not discolour under normal finishing conditions and during care treatments, such as ironing; they are neutral and preferably non-ionic so they neither interact with ionic components of the treating bath nor are affected as regards their gel-forming properties by ions or ionic compounds present as the applicable agents.

It has been found that derivatives of such natural polymers as cellulose, and in particular guar or xanthanes, are very suitable for forming pseudoplastic gels with a wide range of treating formulations. Their viscosity first decreases slowly with an increase of shear, then rapidly. This property is particularly suitable for the application of applicable agents. At zero motion of a porous sheet material, the gel does not penetrate into or through the sheet material, while with increasing travelling speed the viscosity goes down and the surface wetting and penetration go up to the desired level.

The structure may be a porous structure and the gel may be applied as a layer of a thickness determined by the concentration of the active agent present in the preparation and the amount of active agent required to be deposited; and thereafter causing the gel to pass into the porous structure before 75% of the solvent in the system has evaporated.

The properties of the psuedoplastic gel are preferably, in one aspect, adjusted to the relative speed of the porous structure during the application process.

Thus, a practical lower threshold value is the viscosity at which at zero motion virtually no gel drops through the structure or substrate. An upper limit similarly may be defined by the viscosity at which under running conditions intended the pseudoplastic gel is no longer capable of forming a film at the deposition point. In certain cases, of course, it may be desired to deposit an agent under conditions where the gel, due to the speed of deposition or transfer and its viscosity, no longer can form a continuous film; i.e. where gaps or tears form in the layer of gel deposited. This is often desirable if an agent is to be applied locally in random fashion. Local application in a predetermined pattern can, of course, be effected by application or transfer through patterned surfaces, e.g. engraved rollers, (any pattern may thus be produced), by printing methods or by use of ribbed doctor knives (for line patterns).

Another measure of the minimum viscosity of the gelled preparation at zero motion is such that less than 1% by weight of the gel in a layer thereof 5 cm thick applied to the structure and supported only by the surface of the structure or substrate to be treated will dry or flow into the substrate within ten minutes. The maximum viscosity is preferably arranged such that at a speed of 75% of the actual application speed, a continuous coherent layer of the gelled preparation is deposited on the structure surface.

In another aspect the pseudoplastic properties of the gel may be adjusted such that at minimum viscosity and zero motion of the porous structure no significant capillary transport of the solvent containing the agent takes place, while an actual application speed at least superficial wetting takes place.

The constitution of the pseudoplastic gel may also be varied not only in terms of the total weight (including the solvent) added, but also with regard to the way its is deposited over the cross-section of the yarns and fibres or over the structure of weaves or knitted fabrics constituting the substrate. The pseudoplastic gel may thus be forced into the substrate so that it is wrapped around most, or all, of the circumference of the yarns or filaments present in the substrate. Alternatively, segments of the circumference of the yarns or filaments or selected lengths thereof may be covered preferentially. Suitable means for adjusting such predetermined variations are the viscosity of the pseudoplastic gel (the lower it is the deeper the penetration and the more wrapping is obtained); the method of application and deposition of the agent (the higher the forces acting at an angle of 90° to the plane of the substrate, the deeper the penetration and the more wrapping). The viscosity of the pseudoplastic gel may be varied within a wide range to control effects such as depth of penetration, wrapping of yarns or filaments etc, with the pseudoplastic gel.

It is also possible to vary the depth of penetration locally, e.g. by applying the pseudoplastic gel continuously and uniformly and then applying pressure to the structure for instance by means of engraved rollers.

In a further aspect of the invention there is provided apparatus for applying a pseudoplastic gel to a structure which apparatus comprises means for conveying the structure surface to a coating station;

coating means at said coating station to supply a coating of pseudoplastic gel at a predetermined depth to said structure surface and to urge said gel into contact with said structure whereby predetermined gel penetration of the structure is achieved before 75% of the solvent has evaporated.

The means for urging the said gel into contact with the said structure may be selected from a doctor blade apparatus, co-operating transfer rollers, or endless belts, or by rotary or screen printing apparatuses.

Further, the apparatus may comprise means for raising the temperature at the interface between the porous structure and the gel thereby to lower the viscosity of the gel, and increase the speed of take-up.

The gel may be applied to more than one side of the porous structure and when the structure itself is for practical purposes three-dimensional, the gel may be applied to any one of the six surfaces thereby provided. The gel may be forced into the whole of one surface of the porous structure or by suitable arrangement at the applicator station into portions only thereof.

A preferred feature of the apparatus is so designed, that the gel is forced into the substrate before 50% of the solvent has evaporated.

A pseudoplastic gel preparation may be aqueous or non-aqueous, i.e. the solvent present may be water or a non-aqueous liquid, or when the agent to be applied is a liquid itself, no solvent need be present.

The gel may contain one or more agents to be applied to the substrate, these agents may be reactive systems, e.g. a reagent, reaction catalysts or other agents taking part in the reaction or non-reacting agents. Additives such as coloured matter, softeners, lubricants, agents increasing or decreasing water pick-up, flame retardants, soil release agents, and surfactants may be present.

Further, the agents may be capable of interaction. Thus, they cannot be applied in the same formulation, as admixture will cause premature reaction. In this instance the agents may be applied in separate steps, in all but the first as a gel; since if any application after the first one is from a bath, such as, for instance, by padding on a padding mangle, the bath would be contaminated by agents already present in the substrate, while an application in the form of a gel will not cause such undesirable interaction.

The pseudoplastic behaviour of the formulation may be controlled and adjusted by the addition of suitable gelating agents, or, if desired, by mechanical means such as converting the preparation into a mechanically dispersed system such as a foam.

The means used to produce a pseudoplastic gel will be selected, depending on the requirements of the components of the formulation. If, for instance salts are present, gel forming agents not affected by the salts must be used. If non-aqueous formulations are to be gelled, then an agent capable of forming non-aqueous gels would be suitable.

The gels may be applied to the substrate by conventional means such as doctor blade (air knife, knife on roller, knife on rubber belt, etc., ) by transfer from rollers or endless belts (which take up the pseudoplastic paste from a reservoir, the add-on being controlled by conventional means such as a doctor blade) or by printing systems such as screens or rotary screens.

If desired, the ratio between the viscosity of the preparation in the reservoir to the viscosity at the interface between the substrate to which the agent is to be applied and the preparation may be varied. Further, the preparation in the reservoir or during transfer, may be agitated in order to adjust the feeding or transfer rates.

Alternatively, the viscosity of the preparation may be adjusted by temperature. In order to lower the viscosity at pick-up, transfer or application interfaces, the temperature of the preparation, of transfer agents (i.e. knives, rollers, etc) or of the substrate may be increased.

The preparation may, of course, be applied from one or more sides of the structure with the requisite number of applicators adapted to supply the gel, either as a continuous sheet or locally.

Drying of the applied pseudoplastic gel may be effected by hot air, contact with hot bodies such as rollers, or a combination of such means.

Substrates and structures which may be treated in this way comprise sheet materials comprising filaments, yarns and other filamentous material and structures arranged parallel to the long direction of said sheet, for example, textile structures, such as woven or knitted fabrics, non-wovens, webs, sliver, roving, laps and non-textile porous sheet structures. The application of size to yarns and threads in beaming operations prior to weaving thus also falls under the scope of the process according to the present invention. In this particular case, the fact that wetting, and hence agent deposition, can be limited to the peripheral portions of yarns is of particular importance as is the fact that no high pressure squeezing is necessary to remove any excess gel.

Figure 2:
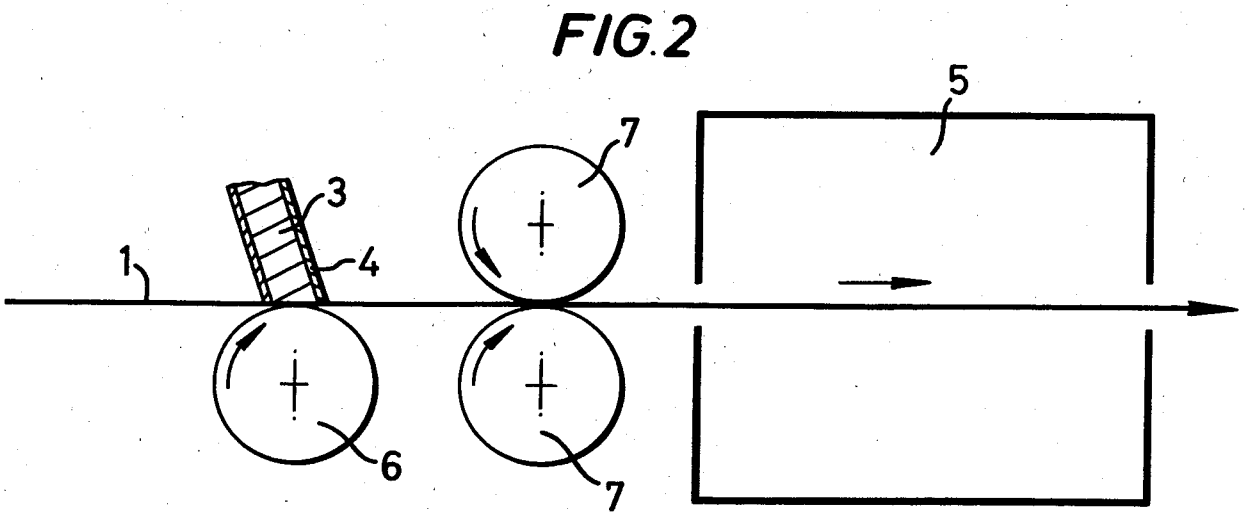

The invention will now be described, by way of illustration only, with reference to the accompanying drawings and to the following examples:

In the drawings:

FIG. 1 shows a diagrammatic vertical cross-section of an applicator apparatus of the invention, and FIG. 2 shows a diagrammatic vertical cross section of a second applicator apparatus in accord with the invention.

In the following description like parts have received the same numbering and function similarly except where noted.

With reference particularly to FIG. 1 a continuous length of a substantially planar porous substrate 1, for example, a woven fabric, moves from the left to the right of the drawing. A container 4 terminates at its lower edge in an opening adjacent a transfer roller 2, a gap between the gel container 4 and the transfer roller 2 being adjustable to allow a continuous supply of the pseudoplastic gel 3 to transfer to the outer circumferential surface of the roller 2 during rotation thereof in the direction of the arrow. Diametrically opposed to the axis of the transfer roller 2 is a support roller 6 which rotates in conformity with the speed of rotation of the transfer roller 2, but of course in an opposite direction. The nip between the rollers 2 and 6 is adjusted such that a desired depth of pseudoplastic gel 3 is transferred onto the porous substrate 1. On leaving the applicator station so provided the porous substrate 1 with a layer of pseudoplastic gel applied thereto is fed to a drier 5 wherein any solvent is evaporated while the correct degree and type of penetration of the pseudoplastic gel into the porous substrate is finalized. Any excess pseudoplastic gel, now thoroughly dried, may be subsequently removed by washing, brushing, or other suitable methods.

In the apparatus shown in FIG. 2 the transfer roller 2 is omitted, and the lower edge of the container is juxtaposed adjacent to the porous substrate at the point at which it is supported on support roller 6. The container 4 is spaced from the porous substrate 1 by an amount sufficient to allow a desired depth of pseudoplastic gel 3 to flow onto the porous substrate as it passes from left to right of the drawing. On leaving the applicator station the porous substrate with the pseudoplastic gel disposed thereon is passed between a pair of opposed pressure rollers 7, the pressure of which is adjustable to achieve a desired depth of penetration of the gel into the substrate. These pressure rollers are only employed when strictly necessary, as, for example, with particularly thick fabrics. The pressure treated substrate passes from the rolls 7 into the drier 5 and is treated thereafter as above described with reference to FIG. 1.

It will be appreciated that the supporting roller 6, and in some circumstances the pressure roller 7 may be substituted by a conveyor belt. The supporting roller 6 may also be utilized, if desired, to apply a second layer of pseudoplastic gel 3 to the undersurface of the substrate, in which case the roller 6 will rotate with its lowermost circumferential surface in a trough containing the pseudoplastic gel 3.

The pressure rollers 7 may, of course, be replaced by devices such as doctor blades, engraving rollers, etc., in order to treat the pseudoplastic gel layer prior to entry into the drier.

Using an apparatus similar to the foregoing the following examples were carried out:

EXAMPLE 1

To an upholstery fabric (polyester/cotton, 220 grams per square meter, thermosol, dyed) an antisoiling agent (flurorcarbon compound) was applied in the form of a pseudoplastic gel. The applicator used consisted of an air knife in contact with the fabric (at an angle of 80°), which was supported by rollers arranged before and after the transfer point. The gel was fed from a trough to the knife. The add-on was 40% on the weight of the fabric, the paste being deposited on the surface only. The desired depth of penetration (25% of the fabric thickness) was achieved by passing the fabric after the application of the gel through the nip of two rollers before drying and curing was carried out (160° C. for 3½ minutes). The speed of the fabric was 20 yards per minute.

The following formulation was used for the preparation of the pseudoplastic gel:
Scothguard FC 455: 80 g/l
Hydroxy-Isopropyl guar as 17 g/l
gel forming agent:
Acetic acid: 2 g/l The pseudoplastic paste was prepared by first dissolving the gel forming agent in half of the total water volume necessary, then adding the other agents and finally the acetic acid.

The viscosity of the paste was adjusted to a level where it did not flow through the fabric when a layer of 5 mm was applied to a piece of the fabric at zero speed, the dwell time being 5 minutes. Due to the pseudoelastic properties of the paste the viscosity dropped to less than half the original value.

EXAMPLE 2

A cotton muslin (42 grams/square meter, pretreated) was treated with a crosslinking formulation, applied in the form of a pseudo-elastic gel. The applicator consisted of two rollers, the upper one carrying a trough containing the paste, which was transferred to the fabric travelling through the nip of the two rollers by the upper roller. The thickness of the film was 0.05 millimeters, the add-on on the fabric was 65% when the fabric was run in dry state, 40% when it contained 50% to 65% water. The formulation used in the form of a pseudoplastic gel had a flow through time of 28 seconds (ford cup, 8 mm diameter).

Dimethylol ethylene urea (50% solids): 70 g/l
Magnesium chloride hexahydrate: 10 g/l
Silicone softener: 30 g/l
Hydroxy-Isopropyl guar: 17 g/l The fabric, in which the formulation penetrated to about 50% of its thickness, was dried to about 5% humidity in a stenter and cured for 3.5 minutes at 150° C.

The tensile and tear strength, creasing angles and wash and wear ratings were better than those obtained by padding with the same add-on of cross-linking agents, but much higher water add-on. These results were comparable to those obtained with other low add-on systems such as application in the form of foam.

EXAMPLE 3

A shirting fabric (poplin, 110 g/square meter, 67% polyester 33% cotton, desized, boiled off, peroxide bleached, mercerised and dyed) was treated with a crosslinking formulation applied in the form of a pseudoplastic gel in the way described in Example 1.

The formulation was

Dimethylol-ethylene urea (50% solids): 100 g/l
Magnesium chloride hexahydrate: 15 g/l
Polyethylene softener: 70 g/l
Xanthane: 12 g/l

EXAMPLE 4

A cotton fabric (poplin, desized, boiled off, bleached with hypochloride, then with peroxide, treated with liquid ammonia and printed with reactive dyestuffs) was treated with a crosslinking formulation, which in one trial was applied by padding, in the second trial in the form of a pseudoplastic gel (with low water add-on). Application of the gel was as described in Example 3. Penetration was all through the fabric. The formulations were

| Paddings | | Pseudoplastic Gel |
|---|---|---|
| 110 g/l | DMDHEU, 50% solids | 200 g/l |
| 22 g/l | Magnesiumhexahydrate | 40 g/l |
| 40 g/l | Silicone softener (25% solids) | 72 g/l |
| | Gel-forming agent | 20 g/l |

In the padding trial, total add-on wet was 75% on the weight of the fabric, with the gel it was 38–40%.

After drying and curing at 150° C. for 4 minutes the samples were tested. Drying of the gel-treated sample was 65% faster than for the padded sample

| | padded | gel treated |
|---|---|---|
| Tensile strength (filling) | 14 kg | 15,5 kg |
| Elmendorf tear (filling | 50 g | 600 g |
| Dry creasing angles (warp plus filling, Monsanto method) | 280° | 280° |
| Wet creasing angles (same as above) | 245° | 260° |
| Accelorotor abrasion (% weight loss) | 4,7% | 2,5% |
| Wash and Wear Rating (Monsanto) | | |
| After 1 washing treat, at 60° C. | 3,5 | 4 |
| After 3 washing treat, at 60° C. | 3,5 | 4 |

I claim:

1. A method of forming a pseudoplastic gel and causing the penetration of said pseudoplastic gel into a porous structure, comprising the steps of: combining an active agent, at least one evaporable solvent therefor, and a given concentration of at least one gel forming agent to form a pseudoplastic gel, applying said pseudoplastic gel in a layer to a porous structure to be treated during movement of said porous structure, applying shear to said layer to cause said pseudoplastic gel to penetrate said porous structure to a depth determined by said applied shear, and subsequent to applying said shear to said layer, evaporating the solvent from said penetrated pseudoplastic gel.

2. A method as defined in claim 1, in which said gel penetrates to said depth before 75% of the solvent has evaporated.

3. A method as defined in claim 2, in which said gel forming agent is guar.

4. A method as defined in claim 1, in which the concentration of said active agent determines the thickness of said layer as initially applied to said porous structure.

5. A method as defined in claim 1 in which the gel is applied in a pattern.

6. A method as defined in claim 1 in which the gel is applied in a random manner.

7. A method as defined in claim 1 in which said porous structure is a fibrous structure having interstices and the gel is forced into said interstices.

8. A method as defined in claim 1 in which the porous structure is formed of yarns, and segments thereof are covered preferentially.

9. A method as defined in claim 1 in which the porous structure is formed of filaments and segments thereof are covered preferentially.

* * * * *